US007213282B1

(12) United States Patent
Wojtowicz

(10) Patent No.: US 7,213,282 B1
(45) Date of Patent: May 8, 2007

(54) CRIB ACCESSORY AND ASSEMBLY

(76) Inventor: Caroline A. Wojtowicz, 123 Parsons St., Easthampton, MA (US) 01027

( * ) Notice: Subject to any disclaimer, the term of this patent is extended or adjusted under 35 U.S.C. 154(b) by 0 days.

(21) Appl. No.: 11/419,587

(22) Filed: May 22, 2006

Related U.S. Application Data

(60) Provisional application No. 60/594,958, filed on May 23, 2005.

(51) Int. Cl.
*A47C 21/08* (2006.01)
*A47D 15/00* (2006.01)
*A47D 7/00* (2006.01)
*A47D 13/06* (2006.01)

(52) U.S. Cl. ..... 5/946; 5/663; 5/425; 5/426; 5/427; 5/93.1

(58) Field of Classification Search ..... 5/93.1, 5/482, 424–427, 496–498, 658, 663, 946, 5/922
See application file for complete search history.

(56) References Cited

U.S. PATENT DOCUMENTS 4,607,402 A * 8/1986 Pollard ..... 5/425
4,754,509 A * 7/1988 Pollard ..... 5/425
4,873,734 A * 10/1989 Pollard ..... 5/425
5,044,025 A * 9/1991 Hunsinger et al. ..... 5/424
5,191,663 A * 3/1993 Holder et al. ..... 5/424
5,351,348 A * 10/1994 Beger ..... 5/420
5,359,739 A * 11/1994 Rains et al. ..... 5/81.1 R
5,530,974 A * 7/1996 Rains et al. ..... 5/81.1 T
5,806,112 A * 9/1998 Harms ..... 5/93.1
5,937,458 A 8/1999 DeRosa
6,772,457 B1 8/2004 Alaback
6,957,455 B1 * 10/2005 Misson ..... 5/425

* cited by examiner

*Primary Examiner*—Robert G. Santos
(74) *Attorney, Agent, or Firm*—Deborah A. Basile; Karen K. Chadwell

(57) ABSTRACT

A crib accessory and assembly comprising a bumper portion comprising: an outer panel, an inner panel, and a padding disposed between the outer and the inner panels. At least one of the outer and the inner panels comprises a plurality of slits distributed along a portion of a length of the respective panel, and an attachment element is looped through at least a portion of the plurality of slits. The attachment element comprises a terminal end comprising a securing element, wherein the securing element attaches the attachment element to a receiving portion located on at least one of the outer and inner panels. The crib accessory further comprises a mattress cover comprising a bottom side flanked by a side wall, wherein the side wall connects the bottom side of the mattress cover to the bumper portion.

18 Claims, 6 Drawing Sheets

CRIB ACCESSORY AND ASSEMBLY

CROSS REFERENCE TO RELATED APPLICATIONS

This application claims the benefit of U.S. Provisional Application No. 60/594,958 filed on May 23, 2005.

BACKGROUND OF THE INVENTION

1. Field of the Invention

The present invention relates generally to a crib accessory, and more specifically to a crib accessory comprising a bumper portion and a mattress cover, wherein the crib accessory provides an impassable barrier to infants and toddlers while simultaneously securing the crib accessory in place on a crib.

2. Background of the Invention

An infant's crib includes a headboard, a footboard and a pair of sides extending between the headboard and footboard. The sides typically are formed with a pair of horizontal rails connected to one another by a plurality of vertically aligned spindles disposed in spaced parallel relationship to one another. The spacing between the spindles permits a flow of air through the region of the crib and enables the parent to observe the child. Furthermore, the spindles in the sides of the crib enable the infant to view the surrounding room. Spindles also are provided in the headboard and footboard of some prior art cribs. Additionally, some prior art cribs include corner posts attached to the head board and foot board, and panels that are spaced inwardly from the corner posts at all locations accept the extreme top and bottom of the respective panels.

The prior art crib further includes a spring that is rigidly connected to the opposed headboard and footboard. The spring may have locking mechanisms attached thereto for permitting selective raising and lowering of at least one side of the crib. A typical prior art locking mechanism includes a foot-actuated latch that can be released to enable the selective lowering of a side of the crib. The latch will engage the side of the crib automatically when the side is raised to its maximum height.

The prior art crib further includes a rectangular mattress supported on the spring. The mattress extends substantially entirely between the opposed headboard and footboard and between sides of the crib. The prior art crib mattress invariably is used with a sheet. Most prior art crib mattresses are used with fitted sheets that have elastic at selected edge locations. The fitted sheet is configured and dimensioned to effectively envelop the top, sides and ends of the mattress and to engage a small portion of the bottom of the mattress. The prior art fitted sheet typically is mounted by at least partly removing the prior art mattress from the crib so that the elastic edges of the fitted sheet can be efficiently engaged under the mattress.

The spacing of spindles in the sides and ends of a crib are small enough to prevent the infant's head from being trapped between adjacent spindles. However, an infant's arm or leg easily can be passed through the spaces between the spindles. Forces exerted by the slats on an arm or leg inadvertently slipped into the space between the spindles can affect the flow of blood to the infant's limb, and thereby can cause permanent damage. In other situations, an infant may injure an arm or leg joint by attempting to turn or roll while a limb is extended between the spindles. In still other situations, a curious infant may catch a finger or toe in the spring or locking mechanism directly beneath the mattress. Still other injuries can occur by contact when the infant rolls or falls into a hard spindle.

In view of these potential problems, most parents utilize a crib bumper. The typical prior art crib bumper is an elongate series of pads disposed in end-to-end relationship. Two of the pads have lengths substantially equal to the length of the crib mattress, while two other pads have lengths substantially equal to the width of the crib mattress. The pads of the prior art crib bumper alternate such that the long pads are in end-to-end relationship with the short pads. The pads are enveloped in a cover that functions to retain the pads in end-to-end relationship. A plurality of strings or ribbons is sewn to the cover at selected locations along at least one edge. More particularly, strings or ribbons typically are sewn near midpoints of the longer pads and at the connections between adjacent pads. The interconnected pads are inserted into the crib and are articulated relative to one another such that the long pads lie adjacent the sides of the crib and such that the short pads lie adjacent to the head board and foot board. The strings or ribbons then are employed to tie the pads of the prior art bumper to the spindles of the crib.

Prior art crib bumpers of this type have been used for generations. However, these prior art crib bumpers are not perfect and room for improvement exists. For example, the above-described prior art crib bumper easily can move upwardly relative to the spindles, thereby leaving a gap between the bottom of the bumper and the top of the mattress. The infant's arm or leg easily can be inserted into the gap between the spindles, thereby permitting the problems described above. Additionally, the functioning of the prior art crib bumper is contingent upon the secure retention of the strings or ribbons on the spindles. An inadvertent loosening or a pulling of the ribbon by a curious infant can lead to a complete collapse and disassembly of the prior art crib bumper.

The above-described prior art crib bumper also is aesthetically undesirable in many respects. In particular, the gap between the bumper and the mattress contributes to the aesthetic unattractiveness.

SUMMARY OF THE INVENTION

Disclosed herein is a crib accessory comprising a bumper portion interconnected with a mattress cover. The bumper portion comprises an outer panel, an inner panel, and a padding disposed between the outer and the inner panels. At least one of the outer and the inner panels comprises a plurality of slits distributed along a portion of a length of the respective panel, and at least one attachment element is looped through at least a portion of the plurality of slits. The attachment element(s) comprises a terminal end comprising a securing element, wherein the securing element attaches the attachment element to a receiving portion located on at least one of the outer and inner panels. The crib accessory further comprises a mattress cover comprising a bottom side flanked by one or more side walls, wherein the side wall(s) connect the bottom side to the bumper portion. The crib accessory is adjustably attachable to a crib by placing a bottom side of the mattress cover underneath a mattress, and by disposing the attachment element(s) of the bumper portion around one or more crib spindles, by drawing the terminal end of the attachment element toward the receiving portion until the bumper portion is taut against the spindles, and then connecting the securing element to the receiving portion. In this manner, the crib accessory can accommodate a variety of sized and shaped cribs.

DETAILED DESCRIPTION OF THE INVENTION

The present invention is directed to an accessory for use on an infant's crib. The crib accessory of the present invention is adapted to buffer an infant from injury and to obscure a crib mattress from view. The crib accessory is further formed to cover at least a substantial portion of the bottom surface of the crib mattress, whereby the weight of the crib mattress exerted on the crib accessory reduces the likelihood that the crib accessory will be displaced from its preferred set position on the crib.

In an exemplary embodiment, the crib accessory comprises a bumper portion integrated with a mattress cover. The bumper portion contains a padding that reduces the likelihood that the head, neck, arms, or legs of an infant will become entrapped in between the spindles of the crib, and further reduces the likelihood of injuries resulting from abrupt contact of the infant with the sides of the crib. In an exemplary embodiment, the mattress cover comprises side portions and a bottom side. The side portions preferably integrally connect the bottom side with the bumper portion such that there are few to no gaps between the mattress cover and the bumper portion, thereby reducing the likelihood that the infant will become entrapped between the spindles located below the sides of the mattress. The bottom side is formed to extend along the entire bottom surface of the crib mattress. Accordingly, the mattress cover of the crib accessory serves to obscure the mattress from view, to protect the infant from injury, and to assist in securing the crib accessory to the crib.

Furthermore, in an exemplary embodiment, the crib accessory comprises a plurality of fastening elements that tightly secure the crib accessory to a plurality of spindles located on the sides of the crib. The fastening elements of the present invention differ from the prior art's use of strings or ribbons in that the fastening elements of the present invention are more resilient to the normal everyday use of the crib accessory, thereby enhancing the usefulness of the crib accessory.

Other objects and advantages of the present invention will become obvious to persons of ordinary skill in the art, and it is intended that these objects and advantages be within the scope of the present invention. To the accomplishment of the above and related objects, the invention may be embodied in the form illustrated in the accompanying drawings, attention being called to the fact, however, that the drawings are illustrative only, and that changes may be made in the specific constructions illustrated.

Figure 1:
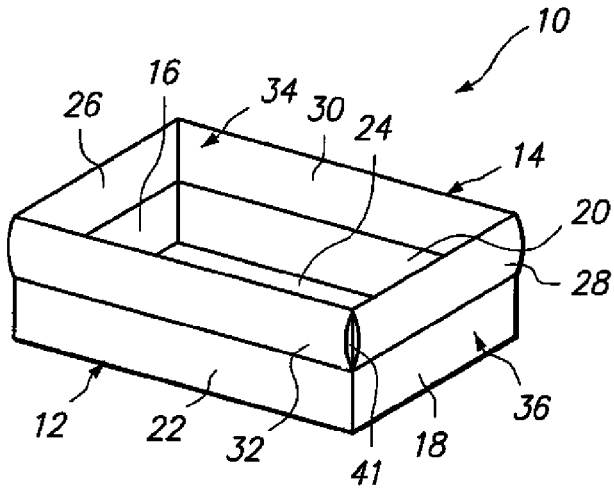
FIG. 1 is a schematic depicting an elevational side view of an exemplary crib accessory.

An exemplary crib accessory is depicted in FIG. 1. Here, a crib accessory 10 comprises a mattress cover 12 attached to a bumper portion 14. Mattress cover 12 comprises a mattress cover head side 16 opposite to a mattress cover foot side 18, and a mattress cover distal side 20 opposite to a mattress cover proximal side 22, wherein mattress cover head and foot sides 16 and 18 are to be respectively aligned with a headboard and footboard of a crib, and mattress head cover distal and proximal lateral sides 20 and 22 are to be respectively aligned with respective lateral sides of the crib, when crib accessory 10 is assembled onto a crib. Mattress cover 12 further comprises a mattress cover bottom side 24 attached to each of side portions 16, 18, 20, and 22. In a preferred embodiment, mattress cover bottom side 24 is formed from the same piece of material as that forming mattress cover head, foot, and lateral sides 16, 18, 20, and 22 such that mattress cover bottom side 24 is continuous with each of mattress cover head, foot, and lateral sides 16, 18, 20, and 22. However, it is contemplated herein that mattress cover bottom side 24 may be otherwise permanently attached to at least one of mattress cover head, foot, and lateral sides 16, 18, 20, and 22 via, for example, stitching, sealing, gluing, and the like, and combinations of the foregoing. Alternatively, mattress cover bottom side 24 may be releasably engaged with mattress cover head, foot, and lateral sides 16, 18, 20, and 22 such as by the use of buttons, zippers, hook and loop fasteners, and the like, and combinations of the foregoing.

Bumper portion 14 comprises an inner panel 34 opposite to an outer panel 36, wherein inner panel 34 is directed towards the interior of the crib and outer panel 36 is directed away from the crib when crib accessory 10 is assembled to the crib. Inner and outer panels 34 and 36 are divided into a bumper head side 26 opposite to a bumper foot side 28, and a bumper proximal lateral side 30 opposite to a bumper distal lateral side 32, wherein bumper head and foot sides 26 and 28 are respectively aligned with the headboard and footboard of a crib, and bumper proximal and distal lateral sides 30 and 32 are respectively aligned with the lateral sides of the crib when crib accessory 10 is assembled onto a crib. In an exemplary embodiment, bumper portion 14 is further comprises a padding 41 disposed between panels 34 and 36 to provide a soft, plush buffer between an infant and the crib, thereby reducing the likelihood of injury to the infant. Padding 41 may comprise any soft, pliable material, such as cotton, polyester, and the like.

Figure 2:
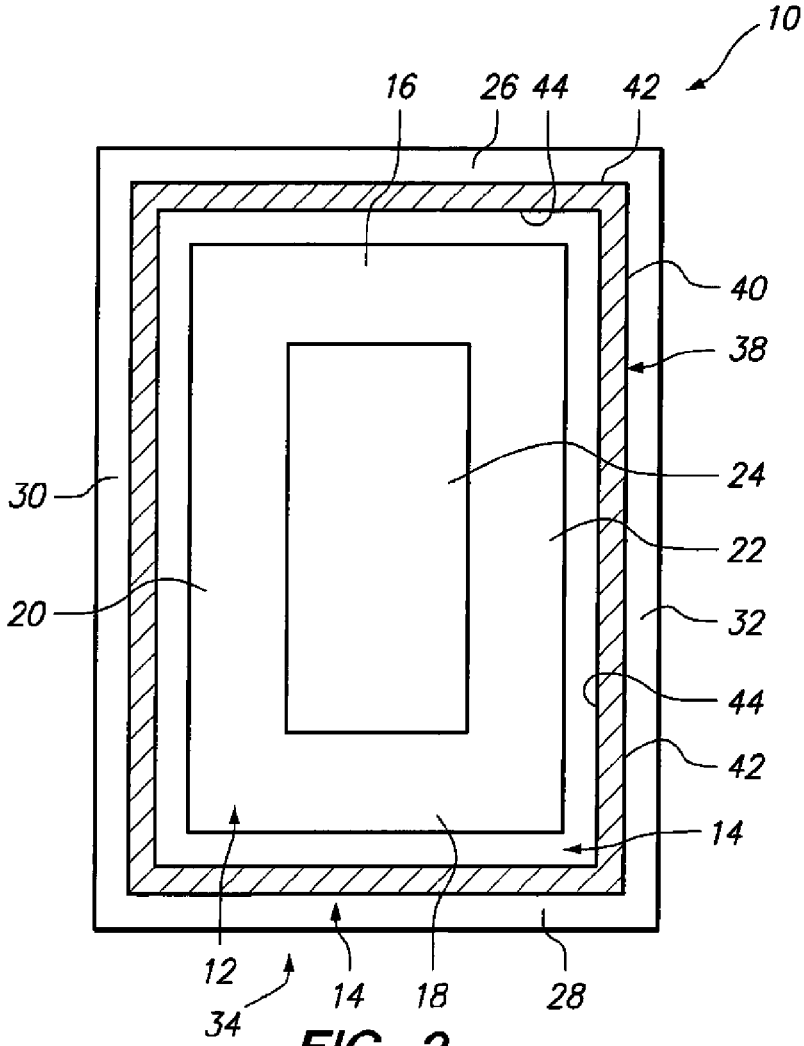
FIG. 2 is a schematic depicting an aerial view of an inner side of an exemplary crib accessory.

In an alternative embodiment depicted in FIG. 2, inner panel 34 comprises a pocket 38 bordered by edges 42 and 44 of bumper portion 14 continuously formed in all of bumper sides 26, 28, 30, and 32 which leads into an interior portion 40. Pocket 38 preferably extends around an entire perimeter of inner panel 34. In an exemplary embodiment, pocket 38 is preferably formed to allow for the insertion of a conventional bumper or other padding within interior portion 40. Although pocket 38 is preferably formed to securely enclose the padding within bumper portion 14, additional securing elements may be used to further hold the bumper within interior portion 40 of bumper portion 14. Such additional securing elements may comprise, for example, buttons holes and corresponding buttons, a zipper and corresponding zipper gripping teeth, hook and loop fasteners and corresponding hook and loop fasteners, receiver snaps and corresponding receiving snaps, wherein the securing elements may be positioned respectively on edges 42 and 44. Although pocket 38 is depicted as being located on inner side 34, it is further contemplated that pocket 38, as well as any optional additional securing elements, may be alternatively or additionally, disposed on outer panel 36 of bumper portion 14.

Alternatively to pocket 38, bumper portion 14 may be closed, such as, for example, by stitching, sealing, gluing, or otherwise thereby enclosing bumper portion 14 around the conventional bumper. In this embodiment, the prior art bumper or other padding may be fitted into the bumper portion during the manufacturing process such that the prior art bumper and the bumper portion 14 and/or all or a portion of mattress cover 12 may be manufactured as a single unit.

However, it is especially preferred that the padding or the conventional bumper be removable from the crib accessory, as such this will facilitate the washing of the crib accessory. That is, by removing the padding, the crib accessory can be washed without the worry of damaging the padding or otherwise affecting the integrity of the padding. Additionally, by providing a removable padding feature, once the padding wears out, it can be easily replaced without the need of acquiring a new crib accessory.

Figure 3:
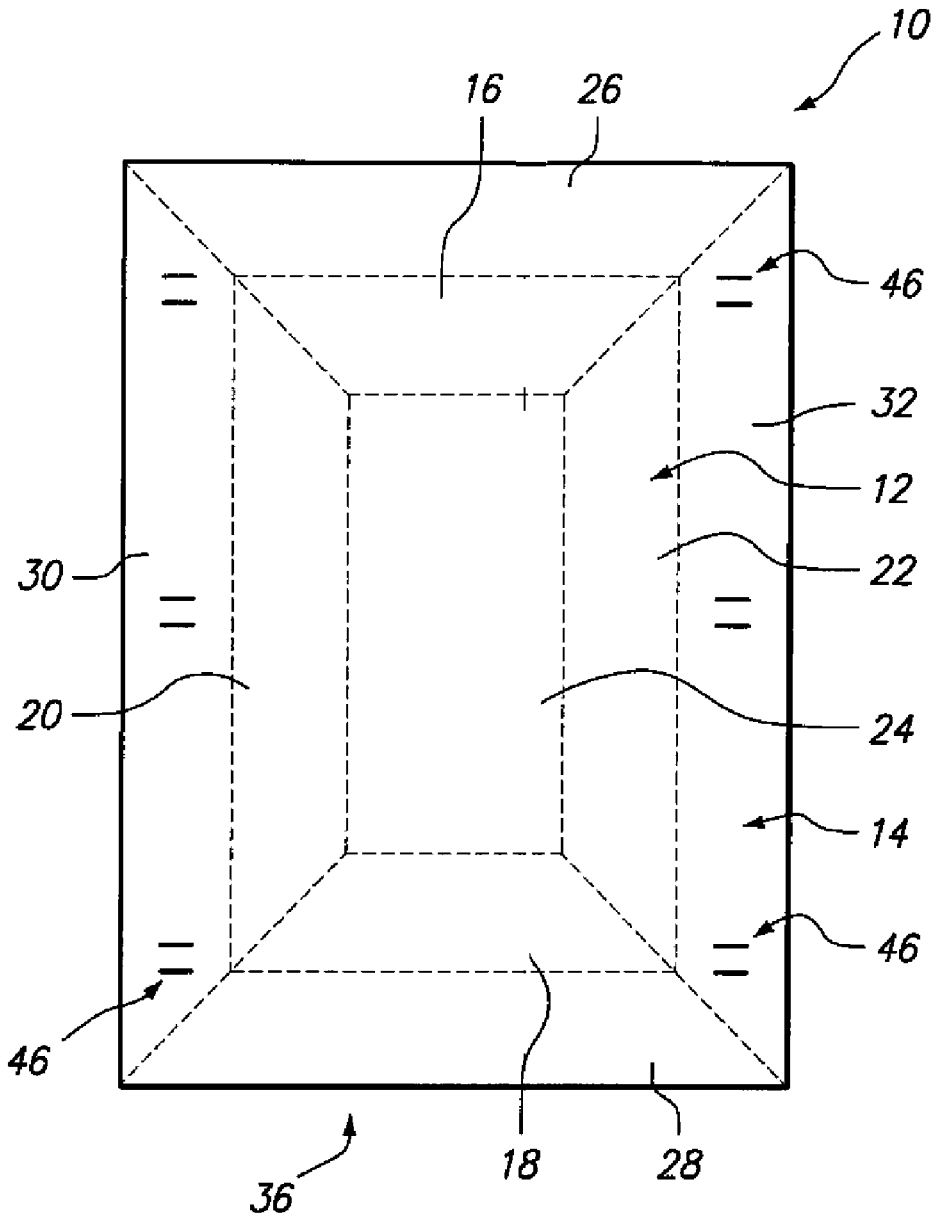
FIG. 3 is a schematic depicting an aerial view of an exemplary outer side of the crib accessory depicted in either of FIGS. 1 and 2.

At least one of inner panel 34 and outer panel 36 comprises a plurality of slits 46 used in association with one or more attachment elements 48 to secure crib accessory 10 onto any sized crib without the need for conventional strings or ribbons. As will be understood more clearly below, the slits are positioned on the bumper portion such that they can receive the securing element without interference from the padding or from the conventional bumper (depending on the structural design of the bumper portion) contained within the bumper portion. For example, where the bumper portion comprises padding 41 disposed between inner panel 34 and outer panel 36, 46 slits are preferably positioned above padding 41. Alternatively, padding 41 also may also contain slits which are aligned with the slits contained on outer panel 36 and/or inner panel 34. Where a conventional bumper is disposed between inner and outer panels 34 and 36, the slits may be positioned above the conventional bumper, or the conventional bumper may be adapted to comprise slits aligned with slits 41 contained on outer panel 36 and/or inner panel 34. Referring to FIG. 3, in an exemplary embodiment, for example, outer panel 36 comprises a plurality of slits 46 interspersed along at least one of bumper sides 26, 28, 30, and 32.

Mattress cover 12 and bumper portion 14 may comprise the same or different materials, as may mattress cover sides 16, 18, 20, 22 and mattress cover bottom side 24. However, in an exemplary embodiment, the materials forming the mattress cover and the bumper portion comprises a washable, durable, and non-abrasive, woven or non-woven, natural or synthetic, pure or blended fabric. Exemplary materials comprise, for example, cotton, polyester, silk, nylon, rayon, and the like, and combinations of the foregoing.

Additionally, the attachment of mattress cover 12 to bumper portion 14 may be permanent or temporary. Temporary attachment, however, may be more preferred in the instance, for example, where it is desired to wash bumper portion 14 without washing mattress cover 12, in which case the crib's mattress would need to be maneuvered to free mattress cover 12. Temporary attachment may be accomplished via buttonholes and corresponding buttons, a zipper and a corresponding zipper teeth panel, a hook and loop fasteners fastener and corresponding hook and loop fasteners receiver, placed on mattress cover 12 and on corresponding portions of bumper portion 14. Permanent attachment may be accomplished by sewing, sealing, gluing, or otherwise permanently integrating mattress cover 12 to bumper portion 14 such that the structural integrity of either of mattress cover 12 and bumper portion 14 is not sacrificed. Alternatively, mattress cover 12 and bumper portion 14 may be formed from a continuous piece of material.

As will be discussed in greater detail below, the attachment element comprises a first terminal end opposite to a second terminal end. The first terminal end may be attached to either of the inner panel or the outer panel of the bumper portion. Such attachment may be permanent, as may be accomplished, for example, by stitching or otherwise sewing, by gluing, by sealing, and the like, the first terminal end to the respective panel. Alternatively such attachment may be temporary, as may be accomplished, for example, by snapping, buttoning, Velcro® fastening by hooks and loops, and the like, the first terminal end to the respective panel. In this manner, then, the first terminal end comprises a securing element, i.e., a snap, a button, a hook and loop fasteners, a stitch, glue, a sealing agent, and the like, which attaches to a receiving portion located on at least one of the inner and outer panels, wherein the receiving portion is complementary to the securing element such that the receiving portion and the securing element act together to hold the first terminal end of the attachment element in place.

The second terminal end of the attachment element also comprises a securing element which is compatible with a receiving portion located on at least one of the inner and outer panels. However, unlike the securing element of the first terminal end which may either be permanent or removable, the securing element of the second terminal end of the attachment element is removable from the respective receiving portion thereby making the bumper portion adjustable such that the crib accessory can fit a variety of sized and shaped cribs.

Figure 12:
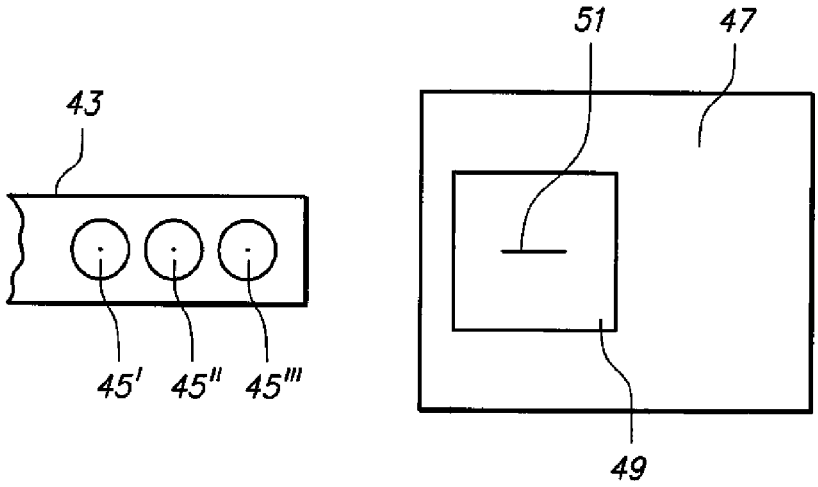
FIG. 12 is a schematic depicting an exemplary securing element and receiving portion.

Not only is this adjustability feature accomplished by having the second terminal end removable from the panels, but also by the arrangement of the securing element as well as the arrangement of the receiving portion. For example, referring to FIG. 12, an exemplary securing element located on a terminal end of an attachment element 43 comprises a plurality of buttons 45 comprising individual buttons 45', 45", 45'". In this exemplary embodiment, an exemplary outer panel 47 comprises a receiving portion 49 which comprises a button hole 51 which receives any one of buttons 45', 45", and 45'". Depending on which of buttons 45', 45", and 45'" is received by button hole 51, the tightness of the bumper portion may be adjusted. It is noted, that this adjustability feature may be accomplished in a number of ways, and that the invention is not limited to any one embodiment. By way of example, and in no way limiting, rather than having a plurality of buttons, the same adjustability feature may be accomplished by having a plurality of snaps positioned on the attachment element, or by having a plurality of button holes on the receiving portion, or by having a plurality of snap receivers on the receiving portion, or by any combination of the foregoing, for example.

In application, then, once the crib accessory is positioned in the crib, it is intended that the second terminal end can be looped through the slits formed in at least one of the inner and outer panels, pulled until the bumper portion is taught against the spindles of the crib, and then secured to its respective receiving element to temporarily lock or fix the crib accessory in place. In this manner, then, the bumper portion is securely held into position as compared to conventional bumper ties.

An exemplary application of crib accessory 10 to a crib 56 is now described with reference to FIGS. 4–11. Referring to FIGS. 4–7, a crib accessory 10 is attached to an interior of crib 56. Mattress cover bottom side 24 of mattress cover 12 is disposed underneath a bottom surface 58 of a mattress 60, preferably such that at least a substantial portion of bottom surface 58 is covered by mattress cover bottom side 24. Mattress cover head, foot, and lateral sides 16, 18, 20, and 22 are aligned with and cover respective lateral sides 62 of mattress 60 such that all lateral sides of mattress 60 are obscured from vision.

Bumper portion 14 extends from mattress cover head, foot, and lateral sides 16, 18, 20, and 22 of mattress cover 12 towards a rail 64 of crib 56. Outer panel 36 of bumper portion 14 abuts a plurality of spindles 68 that connect a rail 70 to rail 64. To fit and to further secure crib accessory 10 to crib 56, one or more adjustable attachment elements 48 are utilized in association with bumper portion 14, more particularly in association with plurality of slits 46, which are located on at least outer panel 36, and more preferably on both outer panel 36 and on inner panel 34, wherein the slits 46 on outer panel 36 are directly across and aligned with slits 46 on inner panel 34.

Figure 4:
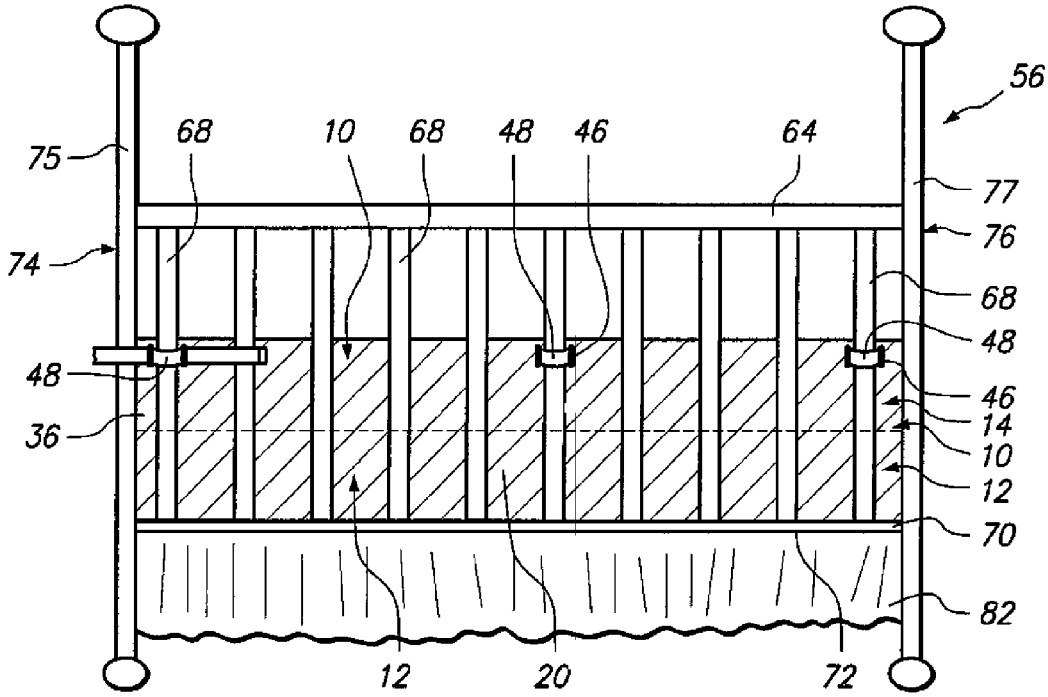
FIG. 4 is a schematic depicting an exemplary crib accessory assembled to a crib.
Figure 5:
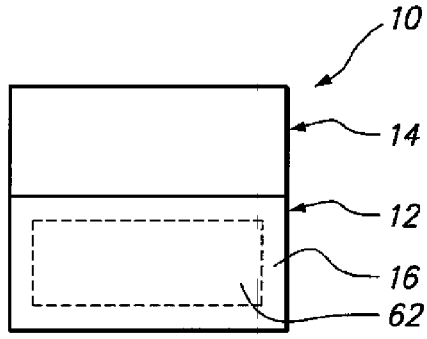
FIG. 5 is a schematic depicting a side view of an exemplary arrangement of the crib accessory depicted in FIG. 1 in relation to an exemplary mattress.
Figure 6:
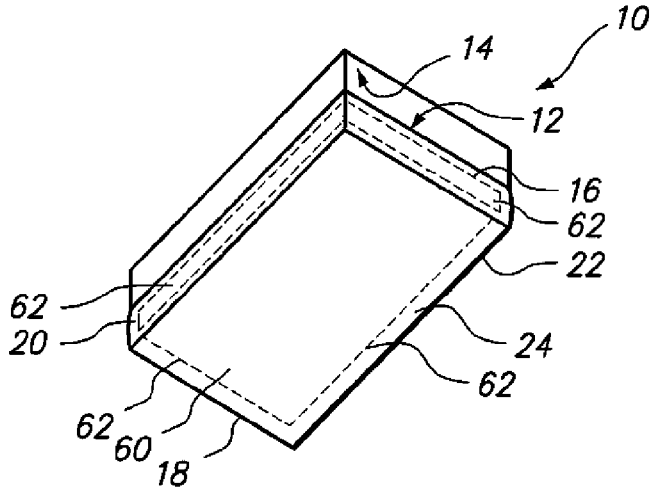
FIG. 6 is a schematic depicting a bottom elevational view of the crib accessory and mattress depicted in FIG. 5.
Figure 7:
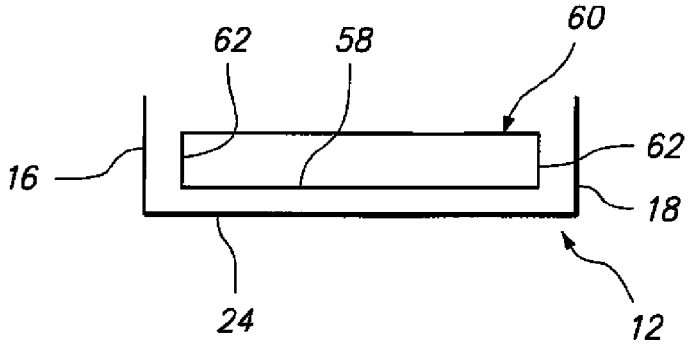
FIG. 7 is a schematic depicting a profile view of an exemplary mattress cover and mattress.
Figure 8:
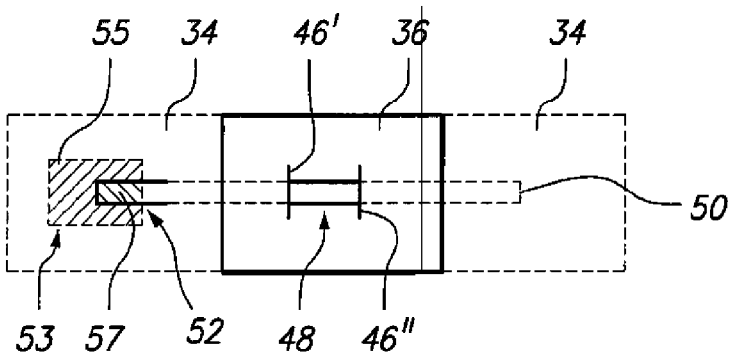
FIG. 8 is a schematic depicting an exemplary adjustable attachment element attached to an exemplary receiving element.
Figure 9:
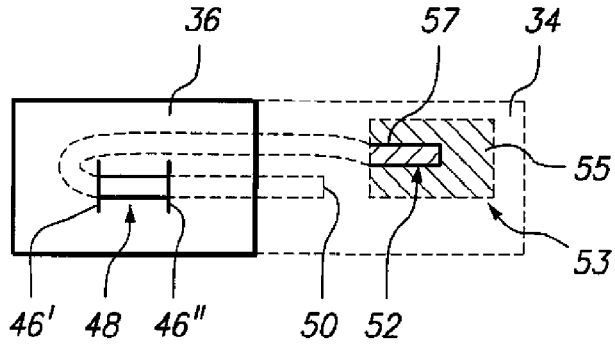
FIG. 9 is a schematic depicting an exemplary adjustable attachment element attached to an exemplary receiving element.

Referring to FIGS. 4, 8, and 9, an exemplary adjustable attachment element 48, which is in the form of a strap, comprises terminal ends 50 and 52. In the embodiments depicted in FIG. 8, terminal end 50 is permanently attached to inner panel 34 via stitching. A receiving element 53 is disposed on inner panel 34, wherein receiving element 53 comprises hook and loop fasteners. Terminal end 52 comprises a securing element comprising complementary hook and loop fasteners which are designed to releasably engage with receiving element 53. In the embodiment depicted in FIG. 8, receiving element 53 comprises a panel of hook and loop fasteners 55 stretched out across a portion of inner panel 34 and terminal end 52 comprises corresponding hook and loop fasteners 57, such that terminal end 52 may be releasably engaged with panel of hook and loop fasteners 55. To engage terminal end 52 with receiving element 53, terminal end 52 is drawn through slits 46' and 46" located on outer panel 36 such that adjustable attachment element 48 fits around one or more of spindles 68 of crib 56. Terminal end 52 is then pulled towards panel of hook and loop fasteners 55, and then engaged with fasteners 55 until the crib accessory is taut on the crib.

FIG. 9 depicts another exemplary arrangement of panel of hook and loop fasteners 55 onto inner panel 34. Here, terminal end 52 is looped through slits 46' and 46" and then turned towards and attached to panel of hook and loop fasteners 55. It is further contemplated that terminal edge 52 of an adjustable attachment element 58 located towards the outer edge of the crib may be wrapped around a head post 75 or a leg post 77 of crib 56 and attached to a receiving element located on either one of inner panel 34 and 36. Therefore, by adjusting the position of terminal end 52 on its respective receiving element 53, the crib accessory can be tightened or loosened on the crib. Accordingly, a single crib accessory may be used on a variety of sized cribs.

Figure 10:
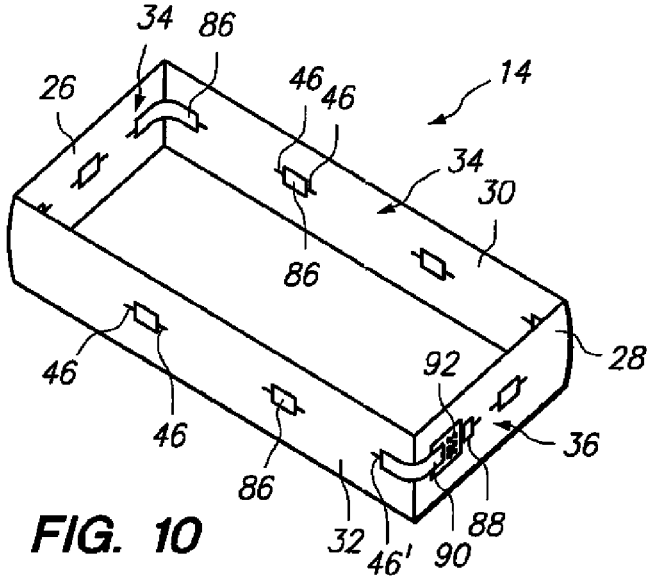
FIG. 10 is a schematic depicting an exemplary arrangement of an attachment element.

Another exemplary arrangement of the attachment element onto the mattress portion is depicted in FIG. 10. Here, a bumper portion 14 comprises a plurality of slits 46. Plurality of slits 46 are distributed along both the inner and outer panels 34 and 36 of bumper sides 26, 28, 30, and 32, wherein the slits on inner panel 34 are aligned with the slits on outer panel 36. Outer panel 36 of bumper foot side 28 comprises a receiving portion 92, wherein receiving portion 92 comprises, for example, hook and loop fasteners. An attachment element 86, in the form of a strap, comprises a first terminal end 88 and a second terminal end 90, wherein second terminal end 90 comprises, for example, hook and loop fasteners complementary to the hook and loop fasteners located on receiving portion 92. First terminal end 88 is permanently attached to outer panel 36 on foot bumper side 28. Second terminal end 90 is looped through each of slits 46 thereby extending the body of the attachment element around the circumference of the bumper portion. Once second terminal end 90 extends through slit 46', it is wrapped over edge 94 and fixed onto receiving portion 92.

Figure 11:
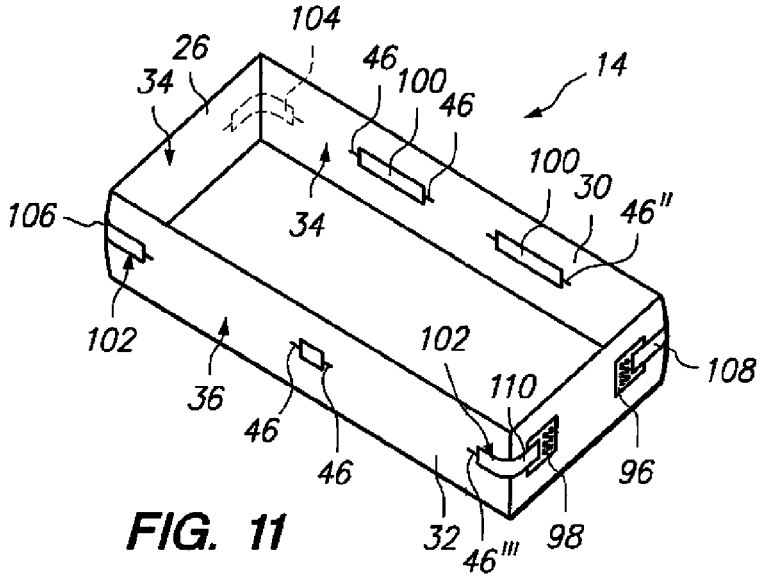
FIG. 11 is a schematic depicting an exemplary arrangement of a plurality of attachment elements.

Referring to FIG. 11, which depicts yet another exemplary arrangement for securing the bumper portion against the spindles of the crib, bumper portion 14 comprises a plurality of slits 46. Plurality of slits 46 are distributed along both the inner and outer panels 34 and 36 of bumper proximal and lateral sides 30 and 32, wherein the slits on inner panel 34 are aligned with the slits on outer panel 36. Outer panel 36 comprises receiving portions 96 and 98 comprising, for example, hook and loop fasteners, located on bumper foot side 28. Here, attachment elements 100 and 102, which are in the form of straps, secure bumper portion onto the crib. Each of attachment elements 100 and 102 respectively comprise a first terminal end 104 and 106 respectively opposite to a second terminal end 108 and 110. First terminal ends 104 and 106 are permanently attached to outer panel 36 on head bumper side 26. Second terminal ends 108 and 110, which comprise, for example, hooks and loop fasteners complementary to the hook and loop fasteners of receiving portions 96 and 98, are looped through their respective slits 46 located on bumper distal and proximal lateral sides 30 and 32. Once second terminal ends 108 and 110 respectively extend through slit 46" and 46'", they are respectively wrapped over edges 112 and 114 and fixed onto respective receiving portions 96 and 98.

Although exemplary attachment elements and their application to an exemplary bumper portion have been described, it is herein noted that a wide variety of adaptations may be made to the embodiments depicted herein. Accordingly, such adaptations are intended to be included herein, and are therefore, incorporated herein in their entirety. Rather, than the exact location and arrangement of the attachment element on the bumper portion, what is most critical to the present invention, and which is, therefore, an improvement over the prior art, is the concept that the attachment element is integrated with the bumper portion by looping it through a plurality of slits located on at least one of the inner and outer panels. At least one of the terminal ends of the attachment element is releasably engaged with a receiving portion located on either of the inner and outer panels, (wherein the outer panel is preferred thereby better preventing the infant from removing the terminal end from the receiving portion), such that the tightness of the bumper portion can be adjusted.

It is noted that, where applicable, the slits are preferably paired such that one of the slits from the pair is aligned with one lateral side of a crib spindle and the other slit from the pair is aligned with the opposite lateral side of the crib spindle. In this manner, then, the attachment element can be looped through the slit and wrapped around a crib spindle, such as is depicted in FIG. 4.

An exemplary method of assembling crib accessory 10 onto crib 56 is now described with reference to FIGS. 4–7. If applicable as determined by the disclosure presented above, a conventionally known bumper (not shown) may be inserted into bumper portion 14 as disclosed above. Crib accessory 10 is positioned within crib 56 such that mattress cover bottom side 24 of mattress cover 12 is disposed on a top side of a platform 72 of crib 56 and such that mattress cover head, foot, and lateral sides 16, 18, 20, and 22 are positioned towards respective headboard 74, footboard 76, and lateral sides 78 and 80 of crib 56. Bumper head, foot, and lateral sides 26, 28, 30, and 32 are positioned such that they abut the spindles on the crib. The attachment element(s) are then looped through the slits and wrapped around the respective spindle. The bumper portion is drawn tightly against the spindles by pulling on one end of the attachment element(s) and then securing that end of the attachment element to the receiving portion located on either the inner or the outer panel. Once the crib accessory is positioned onto the crib, mattress 60 may be positioned on top of mattress cover bottom side 24 of mattress cover 12.

All four sides of the mattress, i.e., the head, foot, and lateral sides of the mattress will be covered from view by mattress cover head, foot and lateral sides 16, 18, 20, and 22 of crib accessory 10. Additionally, the weight of mattress 60 evenly distributed on the bottom side 24 of mattress cover 12 will prevent the crib accessory from sliding 10. Additionally, the attachment element(s) will better secure the bumper portion to the crib as compared to conventional bumper ties. Furthermore, the attachment of the bumper portion to the mattress cover portion further ensures that the mattress will not be visible, and prevents the spacing created between the arrangement of conventional mattresses and conventional bumpers thereby creating a safer way of outfitting a crib.

As to a further discussion of the manner of usage and operation of the present invention, the same should be apparent from the above description. Accordingly, no further discussion relating to the manner of usage and operation will be provided.

It is further contemplated that in lieu of or in addition to the plurality of slits and the plurality of attachment elements disclosed herein, traditional attachment elements as appreciated by one of ordinary skill in the art may be used to attach bumper portion 14 to spindles 68. Therefore, the exemplary and novel attachment means described above are optional; nevertheless, they are seen as being an improvement over the prior art, as they provide a better securing means while simultaneously providing a means whereby the crib accessory may be fitted onto a wide variety of sized cribs, as compared to the prior art.

Figure 13:
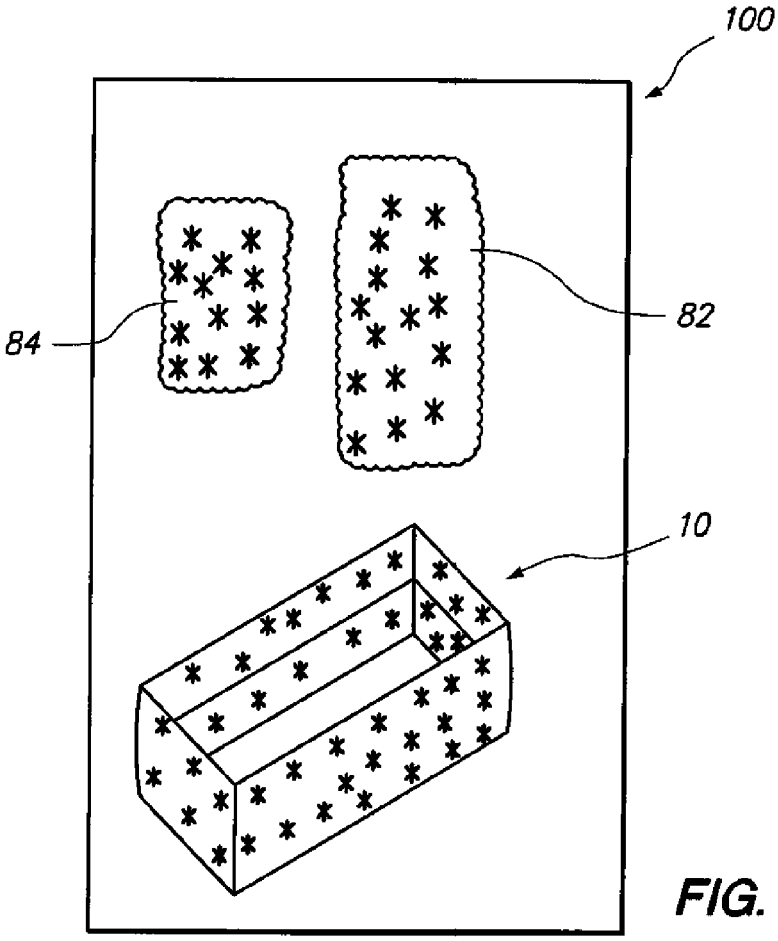
FIG. 13 is a schematic depicting an exemplary kit.

Referring to FIG. 13, in another exemplary embodiment, the invention comprises a kit 100 comprising a crib accessory 10 as disclosed herein, a crib skirt 82 (see also FIG. 4), and a fitted sheet 84, which is fitted over a top surface and the sides of the mattress such that the top surface of the mattress, which is opposite to the bottom surface of the mattress, is covered. Preferably, crib accessory 10, crib skirt 82, and fitted sheet 84 comprise matching patterns such that crib accessory 10, crib skirt 82 and fitted sheet 84 may be aesthetically pleasing when used at the same time on the same crib.

With respect to the above description, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention. Furthermore, those of skill in the art will recognize that the inventive crib accessory can be adapted to crib mattresses of various non-rectangular shapes, such as round mattresses.

As will be obvious to one of ordinary skill in the art, the crib accessory and crib accessory disclosed herein has several advantages over the prior art. For example, because when in use, the mattress of the crib is disposed on top of the mattress cover, the crib accessory is weighted down, thereby restricting the crib accessory from moving when in use. Furthermore, the mattress cover is intended to cover all lateral sides of the mattress, thereby obscuring the mattress cover from view. Further, because the bumper portion and the mattress cover are attached to each other such that no gaps exist between the two elements, the infant's head and limbs will less likely become trapped or ensnared between the spindles of the crib. Additionally, when the novel plurality of attachment elements, as described above herein, are incorporated into the invention, the crib accessory is more fixedly attached to the crib as compared to conventional attachment elements and may be adjusted such that the crib accessory can be fitted to a variety of sized cribs. The present invention is also simple to use, simple and inexpensive to manufacture, and requires very few parts, thereby making it an attractive alternative to traditional crib bumpers.

What is claimed is:

1. A crib accessory comprising:

a bumper portion comprising:

an outer panel;

an inner panel;

a padding disposed between the outer and the inner panels;

wherein at least one of the outer and the inner panels comprises a plurality of slits distributed along at least a portion of a length of the respective panel(s); and an attachment element looped through the plurality of slits, wherein the attachment element comprises a first terminal end opposite to a second terminal end, wherein the first terminal end is connected to either one of the outer panel and the inner panel, and the second terminal end is connected via a securing element to a receiving portion located on either the outer panel or the inner panel; and a mattress cover comprising:

a bottom side flanked by one or more side walls, wherein the one or more side walls connect the bottom side of the mattress cover to the bumper portion.

2. The crib accessory of claim 1, wherein the securing element is adjustably engaged with the receiving portion such that a tautness of the bumper portion is adjustable.

3. The crib accessory of claim 2, wherein the securing element comprises at least one of a button, a snap, and a hook and loop fastener, and wherein the receiving portion respectively comprises at least one of a complementary button hole, snap receiver, and hook and loop fastener.

4. The crib accessory of claim 2, wherein at least one of the inner and the outer panels comprises a pocket whereby the padding is removably inserted between the inner and the outer panels.

5. The crib accessory of claim 2, wherein the plurality of slits comprises a first set of slits formed on the outer panel and a second set of slits formed on the inner panel, wherein the first set of slits is aligned with the second set of slits, and wherein the attachment element is looped through at least a portion of the first and second sets of slits.

6. The crib accessory of claim 5, wherein at least one of the inner and the outer panels comprises a pocket whereby the padding is removably inserted between the inner and the outer panels.

7. A crib accessory comprising:

a bumper portion comprising an outer panel, an inner panel, and a padding disposed between the outer and the inner panels, wherein the outer panel comprises an outer circumference, and further wherein at least one of the outer panel and the inner panel comprises a receiving portion, and further wherein both the inner panel comprises a first plurality of slits and the outer panel comprises a second plurality of slits, wherein the first plurality of slits is aligned with the second plurality of slits;

a mattress cover comprising a mattress cover bottom side flanked by side walls, wherein the side walls are connected to the bumper portion; and an attachment element integrated with the bumper portion, wherein the attachment element comprises a securing element releasable engaged with the receiving portion such that the outer circumference is altered by changing the placement of the securing element relative to the receiving portion and wherein the attachment element is looped through the first and second plurality of slits.

8. The crib accessory of claim 7, wherein at least one of the inner and the outer panel comprises a pocket whereby the padding is removably inserted between the inner and the outer panels.

9. The crib accessory of claim 7, wherein the securing element comprises at least one of a button, a snap, and a hook and loop fastener, and wherein the receiving portion respectively comprises at least one of a complementary button hole, snap receiver, and hook and loop fastener.

10. The crib accessory of claim 7, wherein at least one of the inner and the outer panel comprises a pocket whereby the padding is removably inserted between the inner and the outer panels.

11. An assembly comprising:

a crib comprising a platform and a first set of spindles extending from the platform;

a crib accessory comprising:

a bumper portion comprising an outer panel, an inner panel, and a padding disposed between the inner and the outer panels, and further wherein at least one of the outer and the inner panels comprises a first plurality of slits distributed along at least a portion of a length of the respective panel; and a mattress cover connected to the bumper portion, wherein the mattress cover comprises a bottom side flanked by a side wall;

a mattress comprising a top side opposite to a bottom side, wherein the top and bottom sides are flanked by a side wall connecting the top and bottom sides, wherein:

the bottom side of the mattress cover is disposed between the platform and the bottom side of the mattress, and wherein the mattress cover side wall covers the mattress side wall;

the bumper portion abuts the plurality of spindles; and a first attachment element looped around at least one of the spindles of the first set, and further wherein the first attachment element is looped through the first plurality of slits, wherein the first attachment element comprises a first terminal end opposite to a second terminal end, wherein the first terminal end is connected to either one of the outer panel or the inner panel, and the second terminal end is connected via a first securing element to a first receiving portion located on either the outer panel or the inner panel.

12. The crib accessory of claim 11, wherein at least one of the inner and the outer panels comprises a pocket whereby the padding is removably inserted between the inner and the outer panels.

13. The assembly of claim 11, wherein the first securing element comprises at least one of a button, a snap, and a hook and loop fastener, and wherein the first receiving portion respectively comprises at least one of a complementary button hole, snap receiver, and hook and loop fastener.

14. The assembly of claim 11, wherein the first plurality of slits comprises a first set of slits formed on the outer panel and a second set of slits formed on the inner panel, wherein the first set of slits is aligned with the second set of slits, and wherein the first attachment element is looped through the first and second sets of slits of the first plurality of slits.

15. The assembly of claim 14, wherein:

the crib further comprises:

a second set of spindles extending from the platform; and the crib accessory further comprises:

a second attachment element comprising a first terminal end opposite to a second terminal end, wherein the first terminal end is connected to either one of the outer panel or the inner panel, and the second terminal end is connected via a second securing element to a second receiving portion located on either the outer panel or the inner panel; and a second plurality of slits comprising a first set of slits formed on the outer panel and a second set of slits formed on the inner panel, wherein the first set of slits is aligned with the second set of slits, and wherein the second attachment element is looped through the first and second sets of slits of the second plurality of slits;

whereby the second attachment element is looped around at least one of the spindles of the second set of spindles.

16. The assembly of claim 15, wherein the first securing element of the first attachment element is removably and adjustably secured to the first receiving portion and the second securing element of the second attachment element is removably and adjustably secured to the second receiving portion.

17. The assembly of claim 16, wherein the first and second securing elements of the first and second attachment elements each comprises at least one of a button, a snap, and a hook and loop fastener, and wherein the respective first and second receiving portions respectively comprises at least one of a complementary button hole, snap receiver, and hook and loop fastener.

18. The crib accessory of claim 17, wherein at least one of the inner and the outer panels comprises a pocket whereby the padding is removably inserted between the inner and the outer panels.

* * * * *